United States Patent [19]

Goetz

[11] Patent Number: 4,595,153

[45] Date of Patent: Jun. 17, 1986

[54] PAPER ROLL HOLDER

[76] Inventor: Harold E. Goetz, 1004 First, Dodge City, Kans. 67801

[21] Appl. No.: 729,952

[22] Filed: May 2, 1985

[51] Int. Cl.[4] ..... B65H 16/04

[52] U.S. Cl. ..... 242/55.3; 242/55.2

[58] Field of Search ..... 242/55.3, 55.2, 55.53, 242/55.55, 68.3, 129.5; 225/46

[56] References Cited

U.S. PATENT DOCUMENTS

| | | | |
|---|---|---|---|
| 1,981,673 | 11/1934 | Smith | 242/55.2 |
| 2,240,109 | 4/1941 | Baldwin et al. | 242/55.2 |
| 2,619,297 | 11/1952 | Sharper | 242/55.3 |
| 2,632,606 | 3/1953 | Krueger | 242/55.2 |
| 3,398,908 | 8/1968 | Thompson | 242/55.3 X |
| 3,841,576 | 10/1974 | Farrer | 242/55.2 |
| 4,344,583 | 8/1982 | Drum | 242/55.2 |
| 4,407,459 | 10/1983 | Wormly | 242/55.3 X |

*Primary Examiner*—John M. Jillions
*Attorney, Agent, or Firm*—Harvey B. Jacobson; Clarence A. O'Brien

[57] ABSTRACT

A holder for rolls of paper and the like comprises a frame of rod-like material formed into a loop on which the roll may be held by resiliently flexing one of the loop arms toward the other. The loop has a headed end portion over which the roll is manipulated when pushing it onto the frame or removing it from the frame. The other arm of the loop extends cantilever-fashion from a support and is provided with a brace, while the first arm terminates in a free end adjacent the support. The holder may be provided in single or double-loop models and may have fittings such as a lock, a cigarette lighter, or a night light.

9 Claims, 5 Drawing Figures

PAPER ROLL HOLDER

FIELD OF THE INVENTION

This invention relates to paper roll holders, particularly suited for supporting toilet tissue rolls and the like, but also suited for use with other types of paper rolls and the like. While the invention is described herein as relating to a holder for paper rolls, the term "paper" is used in an exemplary sense to facilitate description of the invention, it is not intended to limit the invention, since the holders described and claimed herein can be used for rolls of other sheet material such as plastic or metal foil.

STATEMENT OF PRIOR ART

Applicant is aware of the following U.S. patents which relate to paper roll holders and the like.

U.S. Pat. No. 1,981,673, 11-20-34
U.S. Pat. No. 2,619,297, 11-25-52
U.S. Pat. No. 2,632,606, 3-24-53
U.S. Pat. No. 3,398,908, 8-27-68
U.S. Pat. No. 3,841,576, 10-15-74
U.S. Pat. No. 4,344,583, 8-17-82
U.S. Pat. No. 4,407,459 10-4-83.

SUMMARY OF THE INVENTION

It is an object of the invention to provide a versatile type of holder structure for paper rolls and the like which can be adapted to diverse commercial and domestic applications; which can have the core of a used roll removed therefrom with one hand without requiring dismantling of the structure; which can similarly have a fresh roll inserted thereon with one hand and without requiring any dismantling of the structure; which will firmly retain a roll thereon while still permitting ready unwinding when required; and which lends itself to incorporation of a night light, cigarette lighter or locking mechanism with the roll structure, the latter effectively preventing theft of an unused roll.

Broadly stated, a holder structure in accordance with the invention comprises a frame of resilient rod-like material such as spring steel formed into an elongate loop having a first arm extending cantilever-wise from a support and terminating in a headed portion forming the base of the loop, a second arm extending from the headed portion back toward the support, the second arm being spaced from the first arm and terminating in a free end so that the second arm may be resiliently flexed toward the first arm for gripping a paper roll pushed onto the frame over the headed portion, and an elongate brace extending from the support at least part way along the first arm. The holder structure is intended for use with paper rolls having an internal core of a diameter somewhat less than the spacing between the arms so that a roll may be manipulated over the headed end of the frame and onto the arms by squeezing the core into elliptical form. This provides inward flexure of the second arm so that when released, the roll is frictionally retained on the frame by the outward spring force of the arms. Adjustments to the friction force or to accomodate rolls of somewhat different internal core diameter can be made by bending the frame.

The frame can be adapted to various types of support bracket and can be provided in single or double-loop versions. In the latter case, the elongate loop and brace members may be replicated on opposite sides of a central support for accommodating a pair of paper or like rolls. The support may be provided with a lock for preventing flexure of the second arm toward the first arm so that when a roll is positioned on the frame it cannot be removed without unlocking the second arm, and the support may also be provided with a cigarette lighter or night light fitting.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF PREFERRED EMBODIMENTS

Figure 1:
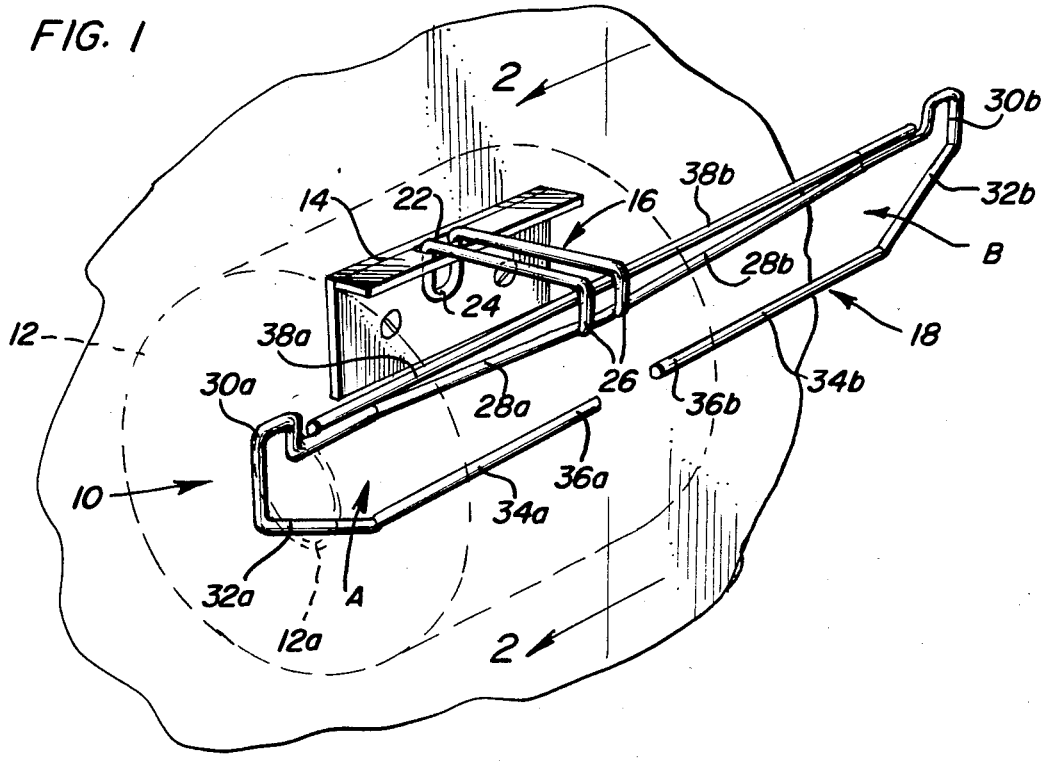
FIG. 1 is a perspective view of a first form of paper roll holder in accordance with the invention.
Figure 2:
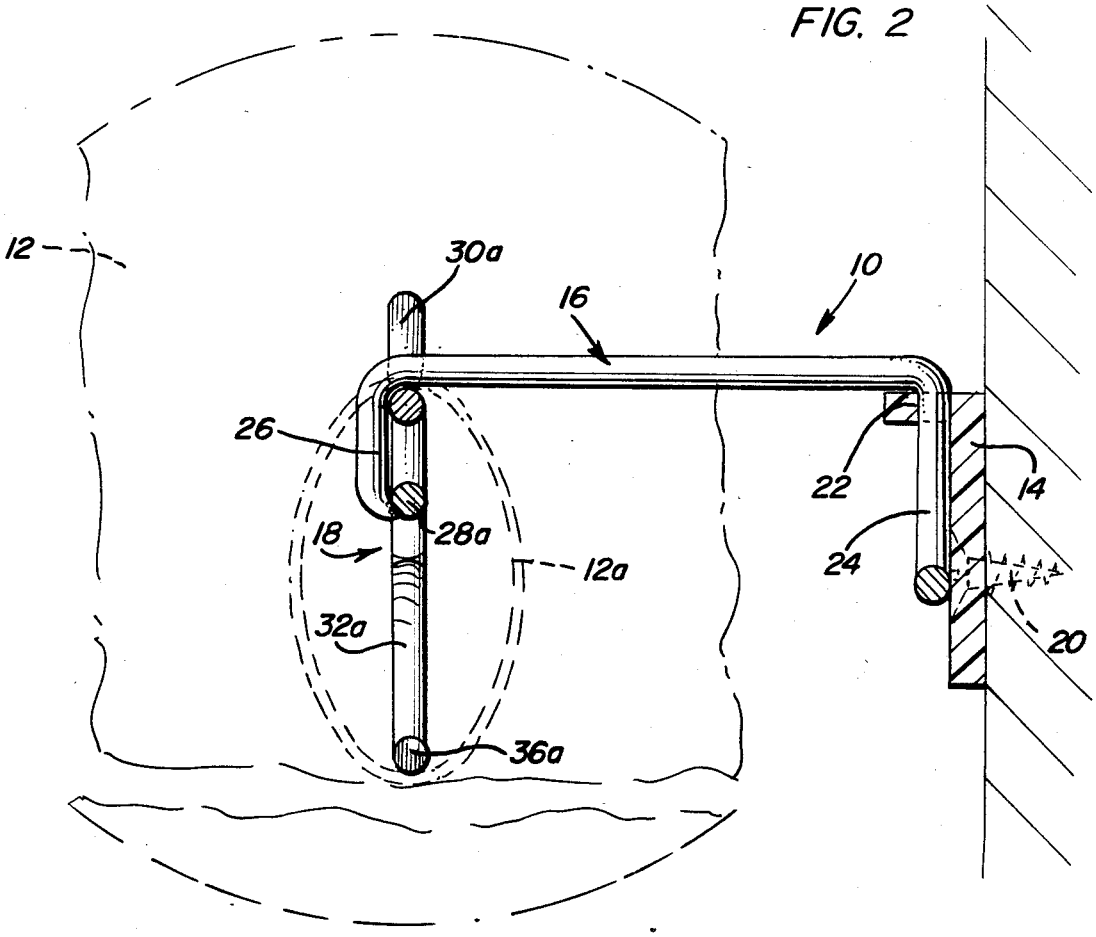
FIG. 2 is an enlarged sectional view on line 2—2 of FIG. 1.

Referring initially to FIGS. 1 and 2, there is illustrated a holder 10 for a pair of paper rolls 12, only one of which is shown in phantom. Holder 10 includes a bracket 14 by which it may be mounted on a wall, a support 16, and a frame 18.

Bracket 14 may comprise a two-piece metal or plastic bracket with holes for screws 20 and a slot 22 for receiving a hook portion 24 of support 16. The support may be made of metal rod and may have prongs 26 onto which frame 18 may be spot welded. The bracket and support are shown by way of example only, and diverse forms of support and support brackets may be used for the frame 18.

The frame is formed of rod material, for example spring steel rod which may have a diameter of 3/32" for domestic applications or 3/16" for commercial applications. The frame has left and right hand loop portions A and B which are substantially mirror images, and the frame is symmetrically mounted on support 16. The loop portions of the frame have respective first arms **28*a*, 28*b* extending cantilever-fashion from support 14, headed portions 30*a*, 30*b* forming the base of the respective loops, and second arms including inclined outer portions 32*a*, 32*b* extending inwardly from the headed portions, and inner portions 34*a*, 34*b* terminating in free ends 36*a*, 36*b*. Further, the holder includes an elongate brace of similar rod material to frame 18, the brace being welded centrally to support 16 and having left and right hand lengths 38*a*, 38*b* extending along the respective first arms 28*a*, 28*b* of the frame and terminating adjacent headed portions 30*a*, 30*b***. The brace may be spot welded to the first arms of the frame so as to support the first arms against bending while the second arms are free to flex resiliently toward the first arms.

The spacing between the first and second arms is somewhat less than the internal diameter of core **12*a* of paper roll 12, so that a roll may be manipulated onto one or other of the loops A or B from its headed portion 30*a* or 30*b* by depressing the roll core to elliptical form and pushing the roll onto the respective frame loop. The respective second arm of the frame loop will flex toward the first arm and, when the roll is released, will serve to retain the roll on the frame loop under slight pressure, due to its inherent resiliency. The frame can be adjusted for tension by bending the respective second arms somewhat, so that a roll is frictionally retained on the frame under a degree of tension while still allowing for ready unrolling of the paper. When the roll has been used up, core 12***a* may be removed from the frame in like manner to its manner of insertion.

While holder 10 has been described as including a pair of frame loops A and B it is equally within the scope of the invention for a holder to have only one of the loops, and a brace corresponding to one of the lengths 38*a*, 38*b*.

Figure 3:
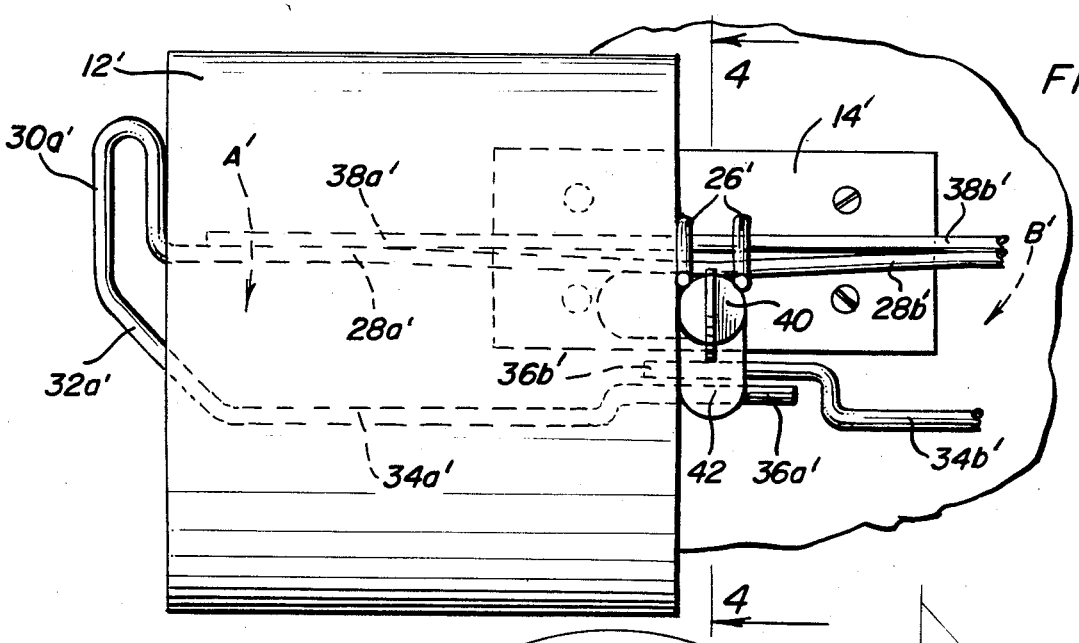
FIG. 3 is an elevational view of part of a second form of paper roll holder in accordance with the invention.
Figure 4:
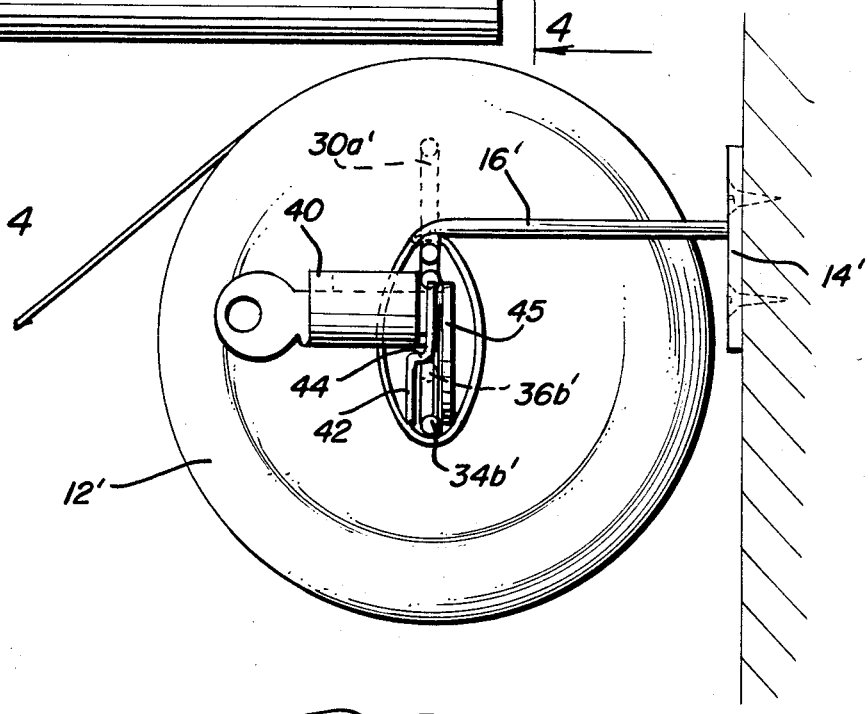
FIG. 4 is a sectional view on line 4—4 of FIG. 3.
Figure 5:
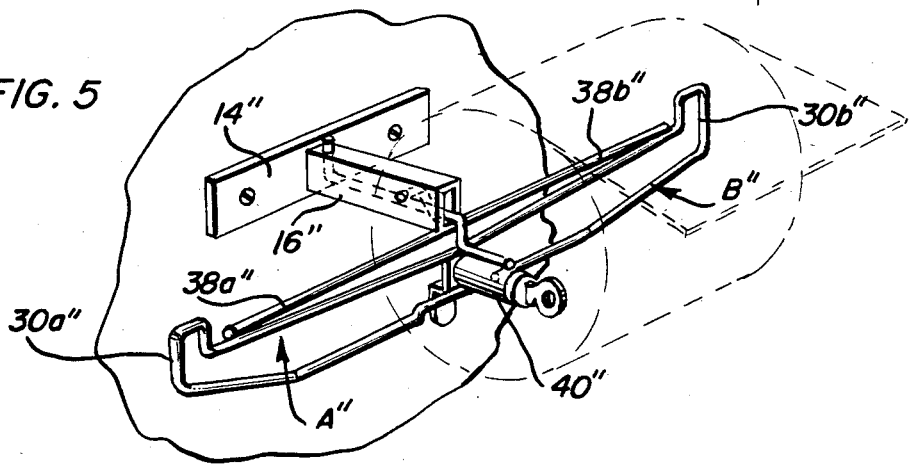
FIG. 5 is a perspective view of a similar form of roll holder to that shown in FIGS. 3 and 4 but having a modified support.

The holder shown in FIGS. 3 and 4 is substantially similar in form to that previously described, except for a modified bracket 14' and the inclusion of a key-operated lock 40 mounted beneath support 16'. Further, the inner ends 36*a'*, and 36*b'* of the lower arms of the respective frame loops A' and B' are extended to overlap beneath the lock. The lock includes a rotary locking plate 42, with a ledge 44 which, when in locked position (see FIG. 4) prevents the ends 36*a'* and 36*b'* of the frame arms from being flexed upwardly, and the lock also has a rotary stabilizing plate 45. Accordingly, when the device is locked, with a roll of paper 12' present on one of the frame loops, the paper roll cannot be removed until the device is unlocked thereby precluding theft of the roll. The device shown in FIG. 5 also has a central lock 40'' operable as above, but has a modified mounting bracket 14'' and support structure 16'' suitable for mounting between wall studs. Any of the devices illustrated may have a night light, cigarette lighter structure, or the like associated with the single support.

It will be appreciated from the foregoing that the invention provides a simple form of paper roll holder which can receive and grip a roll and wherein the roll, and subsequently the used up core, can be inserted onto and removed from the frame of the holder by one hand.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A holder structure for paper rolls and the like comprising and support a frame of rod-like material formed into an elongate loop having a first arm extending cantilever-wise from the support and terminating in a headed portion forming the base of the loop, a second arm extending from the headed portion back toward the support, the second arm being spaced from the first arm and terminating in a free end whereby the second arm may be resiliently flexed toward the first arm for gripping a paper roll pushed onto the frame over the head portion, and an elongate brace extending from the support at least part way along the first arm.

2. The invention of claim 1 wherein the second arm has an outer portion extending from the headed portion in inclined relation away from the first arm, and an inner portion substantially parallel to the first arm and terminating in said free end.

3. The invention of claim 1 wherein the brace is of similar rod material to the frame.

4. The invention of claim 3 wherein the brace is welded to the first arm and located on a side of the first arm opposite the second arm.

5. The invention of claim 1 wherein the free end of the second arm is located substantially adjacent the support and the support includes a lock with a movable locking plate having a locking position for engaging the free end of the second arm preventing same from being flexed toward the first arm and thereby preventing a roll on the frame from being removed.

6. The invention of claim 5 wherein the frame includes a second loop which is substantially a mirror image of the elongate loop on the other side of the support with the free ends of the respective second arms of each loop overlapping whereby each of the loops may be effectively locked by said locking plate, and wherein the structure includes a second brace extending along the first arm of the second loop.

7. The invention of claim 6 wherein the respective loops are formed from a single length of rod-like material and the respective braces are formed from a single length of similar rod-like material.

8. The invention of claim 1 wherein the frame includes a second loop which is substantially a mirror image of the elongate loop on the other side of the support, the structure including a second brace extending along the first arm of the second loop.

9. The invention of claim 8 wherein the respective loops are formed from a single length of the rod-like material and the respective braces are formed from a single length of similar rod-like material.

* * * * *